US009897410B1

(12) United States Patent
Tarip

(10) Patent No.: US 9,897,410 B1
(45) Date of Patent: Feb. 20, 2018

(54) LEVER ACTION PUMP RIFLE

(71) Applicant: Mustafa Tarip, Konya (TR)

(72) Inventor: Mustafa Tarip, Konya (TR)

( * ) Notice: Subject to any disclaimer, the term of this patent is extended or adjusted under 35 U.S.C. 154(b) by 0 days.

(21) Appl. No.: 15/361,081

(22) Filed: Nov. 25, 2016

(51) Int. Cl.
*F41C 7/06* (2006.01)

(52) U.S. Cl.
CPC ..... *F41C 7/06* (2013.01)

(58) Field of Classification Search
CPC ..... F41C 7/00; F41C 7/06
USPC ..... 42/17
See application file for complete search history.

(56) References Cited

U.S. PATENT DOCUMENTS

| | | | | |
|---|---|---|---|---|
| 3,183,615 | A * | 5/1965 | Hirsch | F41A 9/18 42/11 |
| 3,387,398 | A * | 6/1968 | Arndt | F41A 9/23 42/17 |
| 2007/0214696 | A1* | 9/2007 | Barnett | F41C 7/06 42/16 |

FOREIGN PATENT DOCUMENTS

| | | |
|---|---|---|
| DE | 1117446 | * 11/1961 |
| TR | 200802503 | 5/2008 |
| TR | 200708067 | 4/2009 |

* cited by examiner

*Primary Examiner* — Stephen Johnson

(57) ABSTRACT

A rifle (70), including a butt (5) providing support on shoulder during shooting; a charger tube (8) in which cartridges are stored; a band (9) located for shooting of said cartridge; a carrier (41) where the cartridge moving from said charger tube (3) to the barrel (9) stands; a thing pin (28) hitting on the rear portion of the cartridge line with the barrel (9) connected to said trigger wherein it comprises a mechanism (20) containing said firing pin (28); an arm (61) on which said mechanism (20) is located; a lever arm (26) performing the operating procedure of the rifle; an operating handle (50) connected to said lever arm (26) and operating the rifle with movement in A and A' direction; a lever arm sliding channel (43) enabling the sliding of the lever arm (26) on said operating guard (44) in B and B' direction.

5 Claims, 4 Drawing Sheets

LEVER ACTION PUMP RIFLE

TECHNICAL FIELD

The invention relates to pump rifles used for hunting or similar purposes.

The invention particularly relates to an operation mechanism of a rifle wherein it relates to a lever action pump rifle pulling the trigger and setting a gun with a single hand without the use of a handguard.

BACKGROUND

As automated rifles used in the prior art feed barred into a new cartridge with pushing of gas, some amount of the energy resulting from the firing is transferred into the mechanism movement. This deteriorates the precision of the shot and decreases standoff distance.

In the prior art, collapsible and over-and-under rifles using the whole energy for shooting, at most two bullets can be used. This renders a hunter vulnerable in case of an attack by animals during hunting.

In pump rifle systems used in the prior art, the cartridge is fed by holding the grip with one hand and pulling the handguard with the other. This causes time loss and tires human.

As a result of the studies conducted on the literatures, various embodiments relating to said pump rifles are encountered. One of these is a utility model application with application number CN2008/02503 entitled "One-piece pump bolt handle". The abstract of the invention states that "the invention relates to one-piece pump bolt handle performing charge-discharge procedure of the rifle in pump hunting rifle, wherein it consists of two arms and mechanism lower cover and the mechanism has the mechanism lower cover and the one-piece bolt handle on the mechanism lower cover and a pipe at the end of the bolt handle."

Another example relating to said embodiment is a utility model application with application number CN2007/08067 entitled "Collapsible semi-automatic pump hunting rifle". The Abstract of the invention states that "the invention has a guard leaning on shoulder used for hunting purposes, a rifle mechanism, a trigger enabling the shooting and a mechanism arm and a barrel; semi-automatic pump rifle comprises at least one demountable handguard located on the lower portion of said barrel and serving as an operating handle in order to enable carriage of said rifle, disassembly by collapsing for storage and functioning as serial and pump rifle; at least one operation arm moving on said operating handle and having a pump operation button; at least one lower case body carrying the trigger group and having a trigger group disposed therewithin; at least one upper case body carrying the rifle mechanism; at least one butterfly enabling integration by the upper case body key; and at least one trigger group on the charger tube.

Consequently, improvements are performed in parallel with improving technology in pump rifles, thus new embodiment are required to eliminate disadvantages mentioned above and provide solutions to present systems.

SUMMARY OF THE INVENTION

The invention relates to pump rifles constituted by being inspired from present situations, developed to solve said disadvantages and bringing some additional advantages.

An object of the invention is to perform cartridge feeding and shooting procedures with a single hand by improved operating handle.

Another object of the invention is to enable rapid cartridge feeding by the operating handle. Thusly, time and power saving is enabled.

In order to realize the abovementioned objects, a lever action rifle has been developed wherein with movement of the operating handle in operation direction and then settlement direction, the lever arm connected to the operating handle moves the mechanism and provides the cartridge to the barrel, thereby being rendered ready-to-shoot.

A rifle which is operated from handguard in the prior art to bring new point of view to pump hunting rifle has a feature of pulling the trigger and operating the rifle with one hand without the use of a handguard in this system.

It has a structure re-operating the rifle after shooting of the rifle with the developed mechanism group without the need of a handguard.

In order to realize abovementioned object, the mechanism comprises in its body said firing pin; an arm on which said mechanism is located; a lever arm performing operation procedure of the rifle by enabling the feeding of the cartridge from the charger tube to the barrel; an operating handle connected to said lever arm and operating the rifle with movement in A and A' direction; and a lever arm sliding channel enabling the sliding of the lever arm on said operating guard in B and B' direction.

All structural characteristic features and all advantages of the invention will be clearly understood from the detailed description with the following figures and with references to these figures. Thus, assessment should be made considering these drawings and the detailed description.

REFERENCE NUMBERS

Figure 1:
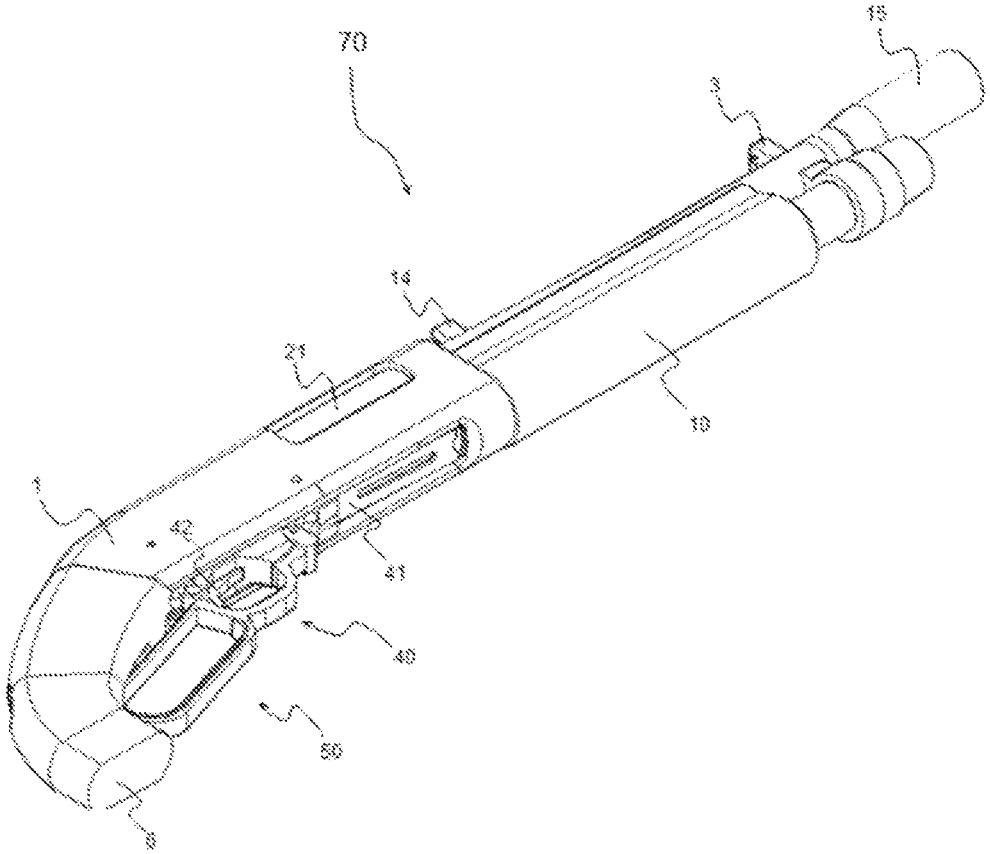
FIG. 1 shows a perspective view of assembled lever action rifle of the invention.

1. Main body
2. Cartridge discharge opening
3. Rear sight
Lever arm rear restriction pulley
5. Lever arm rear restriction pulley pin
6. Butt
7. Butt connection bolt
8. Charger tube
9. Barrel
10. Handguard
11. Handguard connection nut
12. Ring
13. Barrel tightening nut
14. Eye
15. Flash hider

16. Muzzle
20. Mechanism
21. Mechanism body
22. Lock
23. Cartridge puller knockout pin
24. Cartridge puller
25. Pulley connection bolt
26. Lever arm
27. Lever arm connection bolt
28. Firing pin
29. Operating handle pulley
40. Trigger group
41. Carrier
42. Trigger
43. Lever arm sliding channel
44. Operating handle guard
45. Lever arm lower boundary pulley pin
46. Lever arm lower boundary pulley
47. Lever arm tipper boundary pulley pin
48. Lever arm upper boundary pulley
49. Finger protection member
50. Operating handle
51. Operating handle grip
52. Hammer
53. Operating handle connection member
54. Trigger body
60. Arm group
61. Arm
62. Arm connection bed
63. Mechanism hammer connection clearance
70. Rifle
A. Operation direction
A'. Settlement direction
B. Lever arm downward movement direction
B'. Lever arm upward movement direction
A. Mechanism tensioning direction
C. Mechanism feeding direction
B. Carrier feeding direction
D'. Carrier discharge direction
M1. Operating handle rotation axis
M2. Lever arm rotation axis
M3. Carrier rotation axis The drawings should not necessarily be scaled and unnecessary details for the understanding of the invention may have been ignored. Apart from this, elements which are at least substantially similar or have at least substantially similar functions are shown with the same numbers.

DETAILED DESCRIPTION OF THE INVENTION

In this detailed description, preferred embodiments of the lever action rifles (70) of the invention is explained merely for better understanding of the subject and to form no restrictive effect.

The rifle (70) has the butt (6) providing support on shoulder during shooting and a charger tube (8) having cartridge storage; and the barrel (9) located for shooting of said cartridge. The handguard (10) hiding the heat of the barrel (9) during shooting and held for a more balanced shooting comprises the carrier (41) where the cartridge moving from said charger tube (8) to the barrel (9) stands. It consists of the trigger (42) initiating firing of the cartridge fed to said barrel and the firing pin (28) hitting on the rear portion of the cartridge in line with the barrel (9) connected to said trigger. The mechanism (20) containing said firing pin (28) has the arm (61) on which said mechanism (20) is located. It comprises the lever arm (26) performing the operating procedure of the rifle by enabling the feeding of the cartridge from the charger tube (8) to the barrel (9); the operating handle (50) connected to said lever arm (26) and operating the rifle with movement in A and A' direction; and the lever arm sliding channel (43) enabling the sliding of the lever arm (26) on said operating guard (44) in B and B' direction.

FIG. 1 shows assembled perspective view of the lever action rifle (70) of the invention. The rifle (70) consists of the main parts of the butt (6), the operating handle (50), the trigger group (40), the carrier (41), the mechanism (20), the main body (1), the handguard (10), the barrel (9) and the charger tube (8). Furthermore, the rear sight (3), the eye (14) and the flash hider (15) are mounted on the barrel (9).

Figure 2:
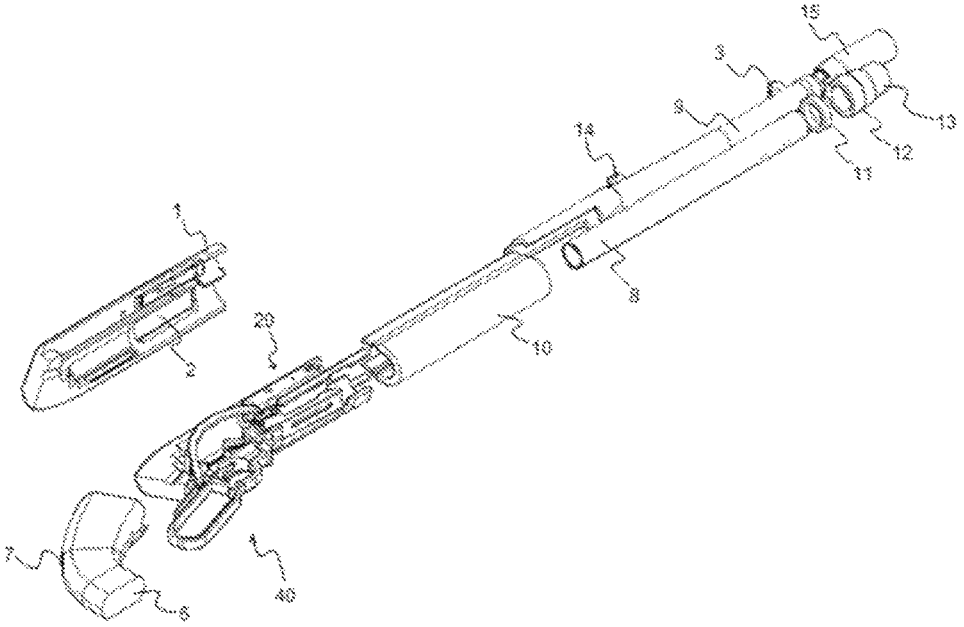
FIG. 2 shows a perspective view of disassembled lever action rifle of the invention.

FIG. 2 is perspective view of the disassembled rifle (70) of the invention. As seen in the figure, the butt (6) is attached to the main body (1) with a butt connection_bolt (7). The operating handle (50) and the trigger group (40) is assembled to the lower portion of the main body (1). The barrel (9) and the charger tube (8) are assembled to the inner portion of the main body (1) such that the barrel (9) is on top. Afterwards, the handguard (10) is attached on the charger tube (8) with the handguard connection_nut (11), the ring (12), and the barrel tightening nut (13).

Figure 3:
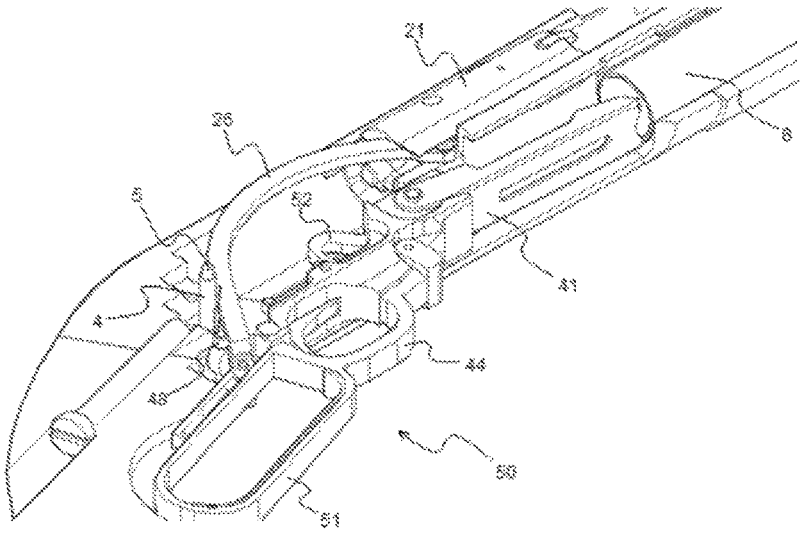
FIG. 3 shows a detailed perspective view of lever arm, mechanism and operating handle of assembled lever action rifle of the invention.

FIG. 3 shows a detailed perspective view of the lever arm (26), the mechanism (20) and the operating handle (50) of assembled rifle (70) of the invention.

Figure 6:
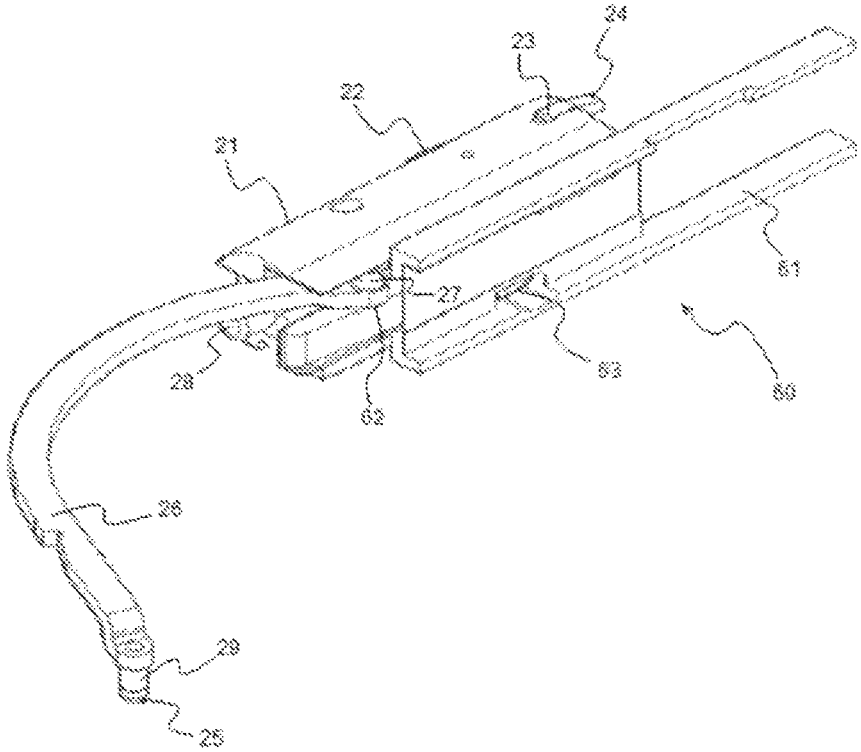
FIG. 6 shows an assembled perspective view of the lever arm and the arm group.

The mechanism (20) has the parts of the lock (22), the cartridge puller knockout pin (23), the cartridge puller (24) and the firing pin (28). FIG. 6 shows assembled perspective view of the mechanism (20), the lever arm (26) and the arm group (60). As seen in the figures, the mechanism body (21) is seated on upper portion of the arm (61). Again, the lever atm (26) is fixed to the arm connection_bed (62) on the arm (61). This procedure is by means of the lever arm connection_bolt (27).

The lever arm (26) is connected from the other side to the operating handle (50). During this procedure, the operating handle pulley (29) is attached to the lever arm sliding channel (43), and secured with the pulley connection_bolt (25). The operating handle (50) is secured to the trigger body (54) with the operating handle connection_member (53). Also, the trigger (42) is assembled on the trigger body (54).

The lever arm lower boundary pulley (46) and the lever arm upper boundary pulley (48) which restrict the movement of the lever arm (26) are secured on the main body (1). This securing procedure is by means of the lever arm upper boundary pulley pin (47) and the lever arm lower boundary pulley pin (45).

Another part restricting the movement of the lever arm (26) when the rifle (70) is operated is the lever arm rear restriction pulley (4) secured to the main body (1) with the lever arm rear restriction pulley connection_pin (5).

It consists of the parts of the operating handle (50), the operating handle guard (44) and the operating handle grip (51). On the inner portion of the operation handle grip (51), there is the finger protection member (49), thereby preventing injuries that may occur during the operation procedure.

There is the cartridge discharge opening (2) where the cartridge corresponding to the upper portion of the carrier (41) portion in the main body (1) leaves the rifle (70). For the movement of said carrier (41), the hammer (52) connected to the arm (61) is secured to the main body (1). There is the mechanism hammer connection clearance (63) on which said hammer (52) is connected to the mechanism body (20).

Figure 4:
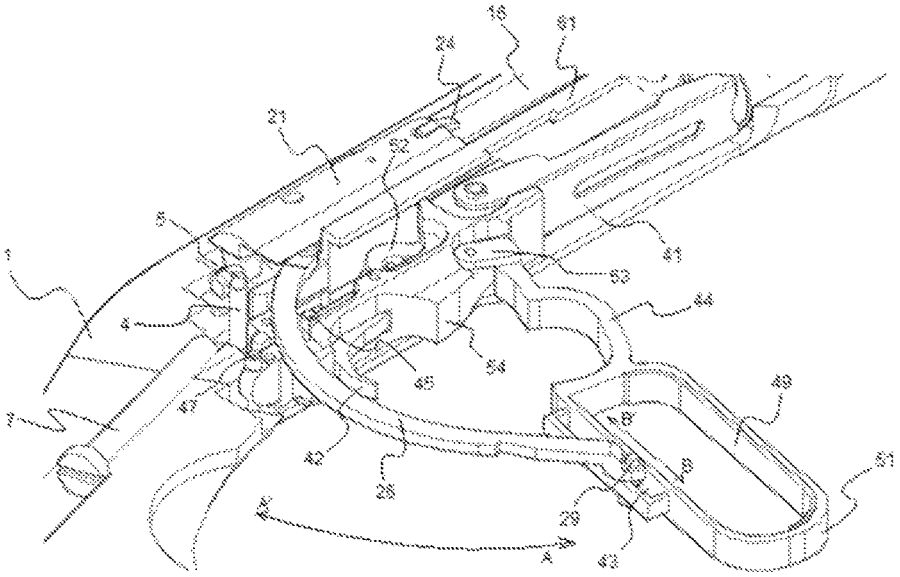
FIG. 4 shows a detailed perspective view of the fall of the cartridge onto the carrier.

Operation Principle:

For the operation of the rifle (70) in normal position, the operating handle (50) is held from the operating handle grip (51) and moved in the operation direction (A). During this procedure, the operating handle (50) rotates from M1; the portion of the arm (61) secured to the arm connection_bed (62) of the arm located on the mechanism (20) of the lever arm (26) rotates in M2 axis. The operating handle pulley (29) slides in downward direction (B) in the lever arm sliding channel (43). Proceeding of the operating handle (50) in the operation direction (A) terminates with the contact of the lever arm (26) to the lever arm lower boundary pulley (46). As the upper portion of the lever arm (26) is connected to the mechanism body (21), downward movement (B) of the lever arm (26) moves the mechanism (20) in mechanism tensioning direction (C). As a result of this procedure, the cartridge from the charger tube (8) falls into the carrier (41). With the help of FIG. 4, procedures explained in this paragraph will be clearly understood.

In this position, the system may be locked by means of the lock (22) on the mechanism body (21).

Figure 5:
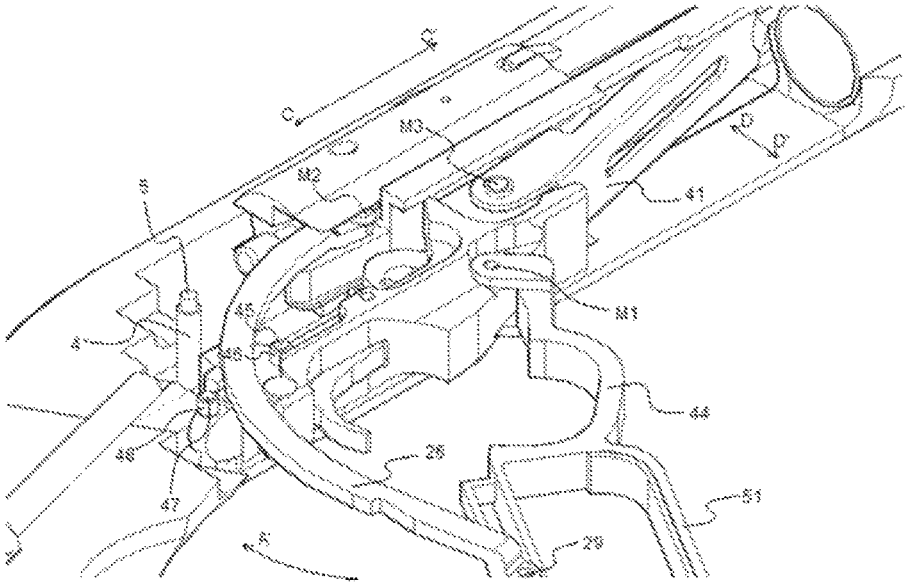
FIG. 5 shows a detailed perspective view of the provision of the cartridge to the barrel.

Afterwards, movement is initiated in the operating handle (50) settlement direction (A'). As explained above, the operating handle (50) rotates in M1 axis and the lever arm (26) in M2 axis. Other end of the lever arm (26) proceeds in upward movement direction (B') with the slide of the operating handle pulley (29) in the lever arm sliding channel (43). Here, the lever arm (26) moves the mechanism (20) in the feeding direction (C'). During this movement, the mechanism body (21) is connected to the hammer (52) from the mechanism hammer connection clearance (63). The hammer (52) rotates the carrier (41) in M3 axis, and moves the carrier in the feeding direction (D). With this movement of the carrier (41), the cartridge on the carrier (41) is fed into the muzzle (16). With the movement of the mechanism (20) in the feeding direction (C') and feeding of the cartridge into the mu771e (16) are simultaneous. The cartridge coining into the muzzle (16) enters into the barrel (9) with pushing of the mechanism body (21) moving in the feeding direction (C). FIG. 5 is a perspective view of the cartridge provision into the barrel (9).

Movement of the operating handle (50) in the settlement direction (A') terminates with the contact of the lever arm (26) with the lever arm upper boundary pulley (4.8) and the lever arm rear restriction pulley (4).

Lastly, the firing pin (28) which is free with the push on the trigger (42) hits the cartridge, thereby enabling the shooting. After the shooting, the mechanism (20) moves in the tensioning direction with the movement of the operating handle (50) in the operation direction (A) again. Meanwhile, empty cartridge is discarded out of the rifle from the cartridge discharge opening (2) by means of the cartridge puller (24).

Protection scope of this application is stated in claims and cannot be restricted to what is explained above with the purpose of exemplification. Novelty of one skilled in the art revealed in the invention can apparently be applied on other fields with similar purpose.

The invention claimed is:

1. A rifle, comprising:

a butt providing a support on a shoulder during shooting; a charger tube in which cartridges are stored;

a barrel located for shooting of said cartridges;

a handguard hiding heat of the barrel generated during shooting and held for a more balanced shooting;

a carrier where the cartridges moving from said charger tube to the barrel stands;

a trigger initiating firing of the cartridges fed to said barrel;

a firing pin hitting on a rear portion of the cartridges in line with the barrel connected to said trigger;

a mechanism containing said firing pin located on an arm;

a lever arm performing a feeding of the cartridges from the charger tube to the barrel;

an operating handle connected to said lever arm and operating the rifle with movements in a first direction; and a lever arm sliding channel formed on the operating handle enabling sliding of the lever arm with respect to the operating handle in a second direction.

2. The rifle according to claim 1, wherein said lever arm comprises an arm connection bed located on an arm, said arm connection bed adapted to connect said arm with said lever arm.

3. The rifle according to claim 1, wherein said lever arm is secured to an arm by a lever arm connection bolt secured to an arm connection bed.

4. The rifle according to claim 1, wherein said lever arm comprises an operating handle pulley connected to the operating handle with said lever arm and enabling sliding of the lever arm in the lever arm sliding channel.

5. The rifle according to claim 1, further comprising:

a lever arm lower boundary pulley restricting movements of said lever arm in the first direction;

an upper boundary pulley restricting movement of said lever arm in a direction;

a lever arm lower boundary pulley pin securing said lever arm lower boundary pulley to an assembly; and a lever arm upper boundary pulley pin securing said upper boundary pulley to the assembly.

* * * * *